United States Patent [19]

Takahashi

[11] Patent Number: 4,913,330

[45] Date of Patent: Apr. 3, 1990

[54] WEB FEEDING APPARATUS

[75] Inventor: Tomohiko Takahashi, Tokyo, Japan

[73] Assignee: Tokyo Shibaura Denki Kabushiki Kaisha, Kawasaki, Japan

[21] Appl. No.: 203,502

[22] Filed: Jun. 6, 1988

Related U.S. Application Data

[63] Continuation of Ser. No. 21,595, Mar. 2, 1987, abandoned, which is a continuation of Ser. No. 594,019, Mar. 27, 1984, abandoned.

[30] Foreign Application Priority Data

Mar. 31, 1983 [JP] Japan ..... 58-55951

[51] Int. Cl.[4] ..... B65H 23/26; B65H 27/00

[52] U.S. Cl. ..... 226/196; 226/168; 242/76

[58] Field of Search ..... 226/17, 21, 88, 188, 226/190, 189, 194, 196, 180, 199, 183, 185, 168; 400/120, 510, 511.3, 511.4; 242/76

[56] References Cited

U.S. PATENT DOCUMENTS

| | | | |
|---|---|---|---|
| 2,177,727 | 10/1939 | Krakaur | 226/189 X |
| 2,358,065 | 9/1944 | Hale | 226/189 X |
| 2,980,306 | 4/1961 | Sullivan | 226/189 X |
| 3,271,835 | 9/1966 | Hadley | 242/76 X |
| 3,306,548 | 2/1967 | Polder | 242/76 X |
| 3,414,954 | 12/1968 | Alexeff | 226/180 X |
| 3,586,229 | 6/1971 | Kamada et al. | 226/180 |
| 4,408,212 | 10/1983 | Moriguchi et al. | 400/120 X |
| 4,421,428 | 12/1983 | Noda et al. | 400/512 X |

FOREIGN PATENT DOCUMENTS

| | | |
|---|---|---|
| 1774596 | 12/1971 | Fed. Rep. of Germany . |
| 2908946 | 9/1979 | Fed. Rep. of Germany . |
| 50-93440 | 7/1975 | Japan . |
| 50-103064 | 8/1975 | Japan . |
| 2022018 | 12/1979 | United Kingdom . |

*Primary Examiner*—Harvey C. Hornsby
*Assistant Examiner*—Scott J. Haughland
*Attorney, Agent, or Firm*—Cushman, Darby & Cushman

[57] ABSTRACT

A web feeding apparatus according to the present invention feeds in one direction a thermal transfer ribbon as a web with low transverse rigidity clamped between a platen roller and a recording head having a predetermined printing range. The web feeding apparatus comprises support members disposed on the lower-course side of the platen roller with respect to one direction and adapted to increase tension on the thermal transfer ribbon at each side edge portion thereof along one direction.

3 Claims, 6 Drawing Sheets

WEB FEEDING APPARATUS

BACKGROUND OF THE INVENTION

This is a continuation of application Ser. No. 021,595 filed Mar. 2, 1987, which was abandoned upon the filing hereof, which is a continuation of Ser. No. 594,019 filed Mar. 27, 1984, now abandoned.

The present invention relates to a web feeding apparatus for feeding a web with a low rigidity across its width, and more specifically to a web feeding apparatus adapted for a thermal transfer ribbon feeding mechanism used in a thermal-transfer recording apparatus as an output recording apparatus of a computer or a word processor.

As one of the non-impact printing systems, a thermal-transfer recording apparatus has recently been developed and put to practical use which is compact, low-priced, noise-free, and capable of recording on ordinary paper.

Such a conventional thermal-transfer recording apparatus (thermal-transfer printer) is shown in FIG. 1. In FIG. 1, transfer sheets P contained in a sheet holder unit 1 are taken out one after another by a takeout roller 2. Thereafter, the sheet P is carried between a pair of aligning rollers 3*a* and 3*b* to a printing section A. At the same time, an unused thermal transfer ribbon 4 wound on a roll shaft 7*a* is fed under tension T1 to the printing section A, and driven by the rotation of a platen roller 6 pressed against a thermal head 5 and the rotation of a roll shaft 7*b*. After the sheet P is printed through the medium of the thermal transfer ribbon 4 at the printing section A, the ribbon 4 is separated from the sheet P by a ribbon feeding guide 8*c*. Then, the sheet P is discharged onto a tray 10 by an exit roller 9, while the used ribbon 4 is wound on the roll shaft 7*b* under tension T2 (T2>T1).

Usually, the thermal transfer ribbon 4 has a width of approximately 230 mm so that it can be used with any sheets P having an A-4 size, letter size, or a legal size. For increased thermal conductivity, the thermal transfer ribbon 4 is coated with a thin film 4*a* of approximately 10 microns thick as a base material for the thermal-transfer ink 4*b*.

The thermal transfer ribbon 4 in the form of a wide, thin film must be fed at long intervals of 300 mm or thereabouts. Without any rigidity across the width, therefore, the ribbon 4 would be greatly influenced by any unevenness in the transverse tension in strength and direction during the feed. As a result, the ribbon 4 could easily be subject to undulations 11, as shown in FIG. 2. These undulations 11 can grow and can then be crushed into wrinkles at or prior to reaching the printing section A. If this happens, parts of the thermal transfer ribbon 4 will overlap one another to form the thick wrinkled portions 12, as shown in FIG. 3. Thus, these wrinkled portions 12 cannot be supplied with enough heat to melt the ink 4*b*, and the sheet P and the thermal transfer ribbon 4 cannot contact each other about the wrinkled portions 12. Accordingly, the sheet P will have unprintable portions which can cause printing errors.

Conventionally, therefore, condenser paper having some rigidity across the width has been used as the material for a wide thermal transfer ribbon 4. Although rigid and less liable to wrinkles, however, the condenser paper is so breakable that the printing operation must often be interrupted. Therefore, polyester film with a thickness of, e.g., several microns, which is much less fragile, is used in some thermal transfer ribbons. In this case, the interruption of the printing operation attributed to the breaking of the ribbon may surely be avoided. Although less fragile than the condenser paper, however, the thermal transfer ribbon of this type is so low in rigidity across its width that it is still liable to wrinkles, which result in printing errors.

In the thermal transfer ribbon feeding apparatus of the thermal-transfer printer shown in FIG. 1, the thermal transfer ribbon 4 is mainly fed by the rotation of the platen roller 6 which is pressed against the thermal head 5. At the same time, the ribbon 4 is driven by the winding tension T2 produced by the roll shaft 7*b*. Therefore, in order to feed the thermal transfer ribbon 4 whose base material is formed of, for example, a polyester film, both the pressure between the thermal head 5 and the platen roller 6, and the winding tension T2 need to be uniform along the width of the thermal transfer ribbon 4.

The pressure between the thermal head 5 and the platen roller 6 across the width of the thermal transfer ribbon 4 can be distributed uniformly by using a one-point rockably supported mechanism for holding the thermal head 5. However, the winding tension T2 can become uneven along the width of the thermal transfer ribbon 4 by the particular distortion of the ribbon 4, by printing heat, or by the irregular winding of the ribbon 4 on the roll shaft 7*b*. As a result, undulations 11 are formed, causing wrinkles. Thus, in order to prevent printing errors caused by wrinkles on the thermal transfer ribbon 4, the transverse tension in the printing region of the ribbon 4 has been made uniform in distribution.

SUMMARY OF THE INVENTION

The present invention is contrived in consideration of these circumstances, and is intended to provide a web feeding apparatus having a simple construction in which a web, such as a thermal transfer ribbon, is fed in a manner such that the middle portion of the web is passed around a platen roller facing a recording head, and in which the transverse tension on that portion of the web which faces the platen roller can be made uniform to prevent the formation of wrinkles.

In order to achieve the above object, a web feeding apparatus according to the invention is provided with a tension increasing means disposed on the lower-course side of a platen roller with respect to the web feeding direction which is adapted to increase the tension on the side edges of the web along the feeding direction, thereby preventing the formation of wrinkles on that portion of the web which faces the platen roller.

DETAILED DESCRIPTION OF THE PREFERRED EMBODIMENTS

A first embodiment of a web feeding apparatus according to the present invention will now be described in detail with reference to the drawings of FIGS. 4 to 6.

Figure 1:
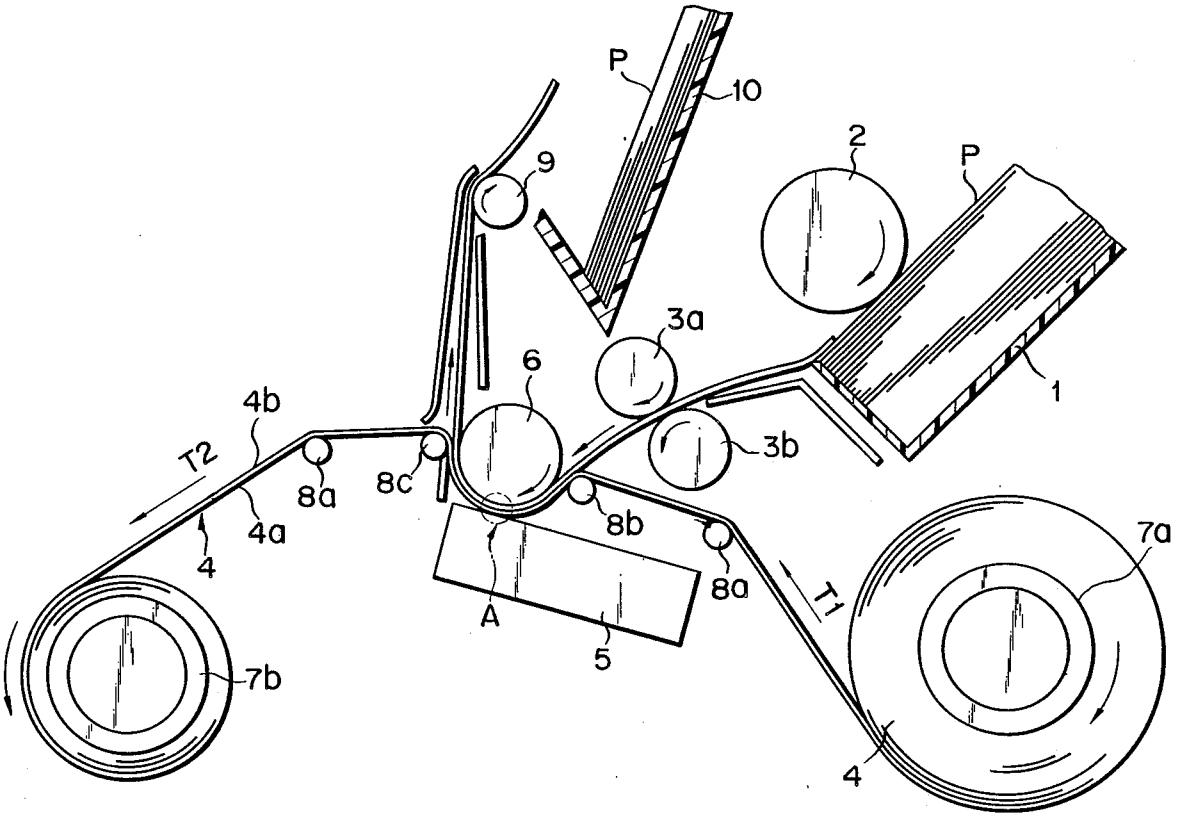
FIG. 1 (PRIOR ART)
FIG. 1 is a side view schematically showing a prior art web feeding apparatus.
Figure 2:
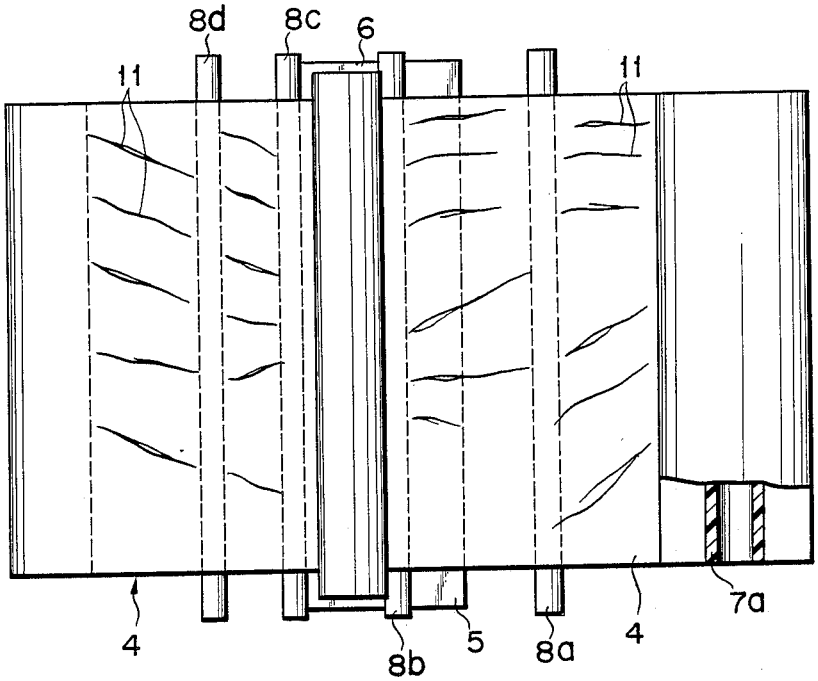
FIG. 2 (PRIOR ART)
FIG. 2 is a plan view showing how a thermal transfer ribbon undulates in the prior art apparatus.
Figure 3:
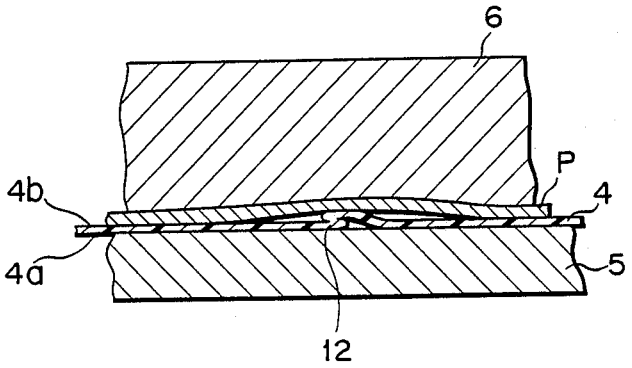
FIG. 3 (PRIOR ART)
FIG. 3 is a sectional view showing how the thermal transfer ribbon is wrinkled in the prior art apparatus.
Figure 4:
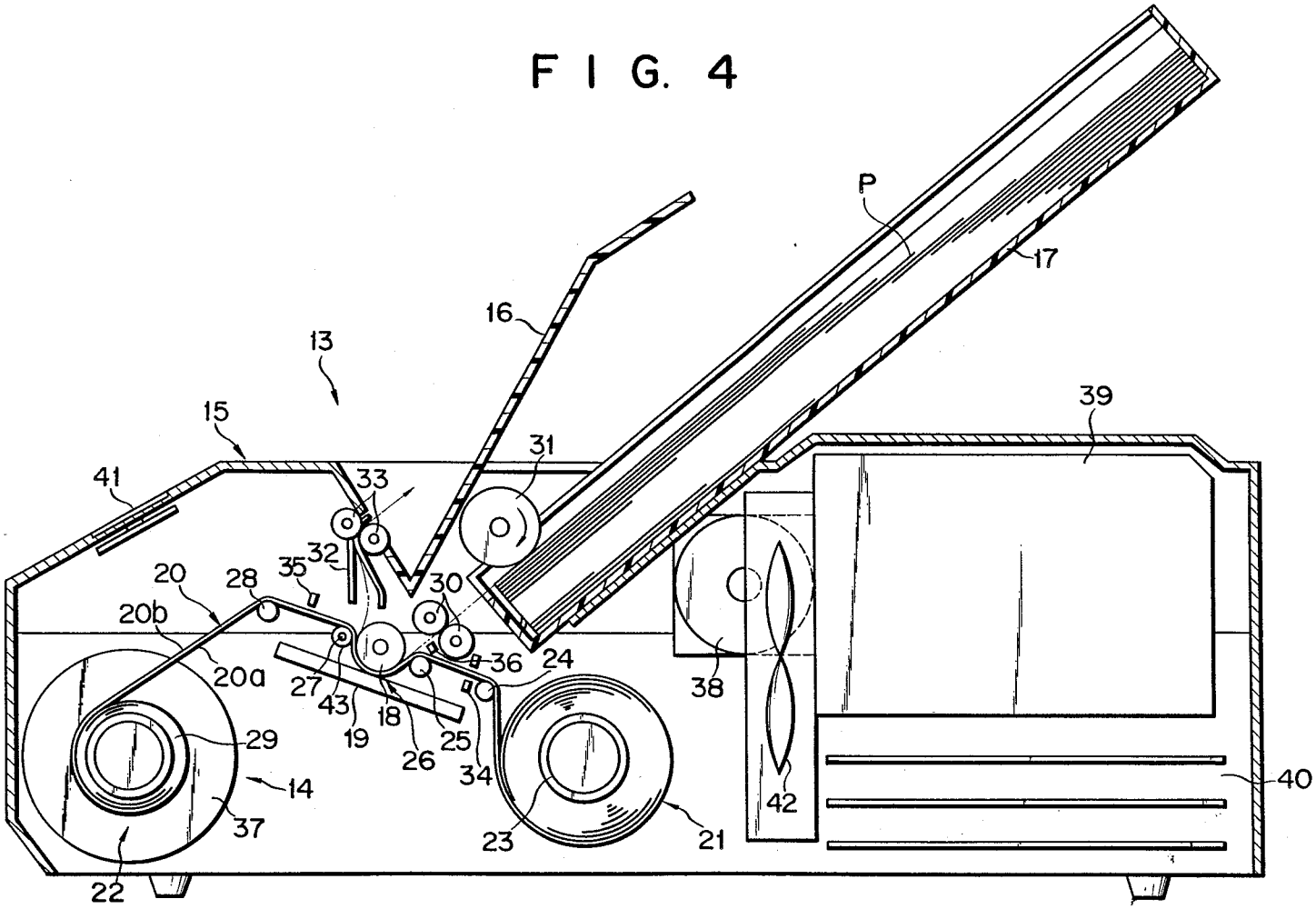
FIG. 4 is a side view schematically showing a web feeding apparatus according to a first embodiment of the present invention.

FIG. 4 schematically shows the general construction of the thermal-transfer recording apparatus 13 provided with a ribbon feeding mechanism 14 as a web feeding apparatus according to the first embodiment. In FIG. 4, numeral 15 designates the apparatus housing. A tray 16 and a paper cassette 17 are attached to the middle and rear portions, respectively, of the top of the housing 15. A platen roller 18 is disposed in the position corresponding to the mounting portion of the tray 16 inside the housing 15. Under the platen roller 18 lies a thermal head 19 with a line-dot-shaped heat-generating portion (not shown) which extends along the axis of the platen roller 18.

A ribbon holding unit 21 of the ribbon feeding mechanism 14 which holds the rolled thermal transfer ribbon 20 as a web is provided substantially in the center of the interior of the housing 15. Also, a ribbon take-up unit 22 of the ribbon feeding mechanism 14 which winds the thermal transfer ribbon 20 let out from the ribbon holding unit 21 is located in the front portion of the interior of the housing 15.

The extreme end of the thermal transfer ribbon 20 which is wound on a roll shaft 23 of the ribbon holding unit 21 is passed successively around a pair of feed rollers 24 and a guide roller 25, is passed through a printing section 26 defined between the platen roller 18 and the thermal head 19, and is then turned around a small separation roller 27 so that the end of the ribbon 20 is suddenly removed from the platen roller 18. Afterwards, the thermal transfer ribbon 20 is passed around a guide roller 28, and is wound on a roll shaft 29 of the ribbon take-up unit 22, thus defining the ribbon take-up path.

A pair of aligning rollers 30 is arranged in the vicinity of the guide roller 25. A transfer sheet P as an objective material for transfer (recording medium) delivered from the paper cassette 17 by a takeout roller 31 is fed to the printing section 26 defined between the platen roller 18 and the thermal transfer ribbon 20 by the aligning rollers 30.

A pair of guide plates 32 and a pair of exit rollers 33 are arranged in succession, ranging from the separation roller 27 to the tray 16. The transfer sheet P separated from the thermal transfer ribbon 20 is led to the tray 16 via the guide plates 32 and the exit rollers 33, thus defining a transfer sheet travel path.

A ribbon end detector 34 is disposed between the pair of feed rollers 24 and the guide roller 25 on the ribbon take-up path, while a ribbon sag/cut detector 35 is provided between the separation roller 27 and the guide roller 28. Likewise, a transfer sheet passage detector 36 is disposed between the paper cassette 17 and the pair of aligning rollers 30.

The takeout roller 31, the aligning rollers 30, the platen roller 26, the exit rollers 33, nd a take-up reel 37 holding the roll shaft 29 are driven by a common pulse motor 38 as a drive source. Numerals 39, 40, 41 and 42 designate a power supply section, a control section, a display/operation input section, and a cooling fan, respectively.

The thermal transfer ribbon 20 is formed of film 20*a* as the base material having approximately polyester a thickness of 10-microns, and a thermal-transfer ink layer 20*b* put on the material 20*b* by coating. The ribbon 20 is stretched in a manner such that the ink layer 20*b* is in contact with the sheet P.

The separation roller 27 is located on the lower side of the platen roller 18 with respect to the feeding direction of the thermal transfer ribbon 20. It serves also as a thermal transfer sheet feeding guide nearest to the platen roller 18. Support members 43 as a tension increasing means are integrally attached to both end of the separation roller 27.

The inner edges 43*a* of support members 43 are each located downstream of and interiorly disposed relative to a respective corresponding edge 18*a* of the platen roller 18. The inner edges 43*a* are also located outside of the cross-hatched printing region X as is shown in FIG. 6. this first embodiment, the outer edge of each support member 43 is substantially flush with the corresponding edge of the platen roller 18.

The support members 43 are each in the form of a roll coaxial with the separation roller 27 which is only a little larger in diameter than the separation roller 27. In other words, the outer peripheral surface of each support member 43 radially projects slightly outward from that of the separation roller 27. In this first embodiment, the width of the ribbon 20 is 230 mm, the axial length of the platen roller 18 is 220 mm, and the axial length of each support member 43 is 5 mm. The diameters of the separation roller 27 and each support member 43 are 6 mm and 6.6 mm, respectively. Thus, the outer peripheral surface of each support member 43 projects radially outward from that of the separation roller 27 by 0.3 mm.

Figure 5:
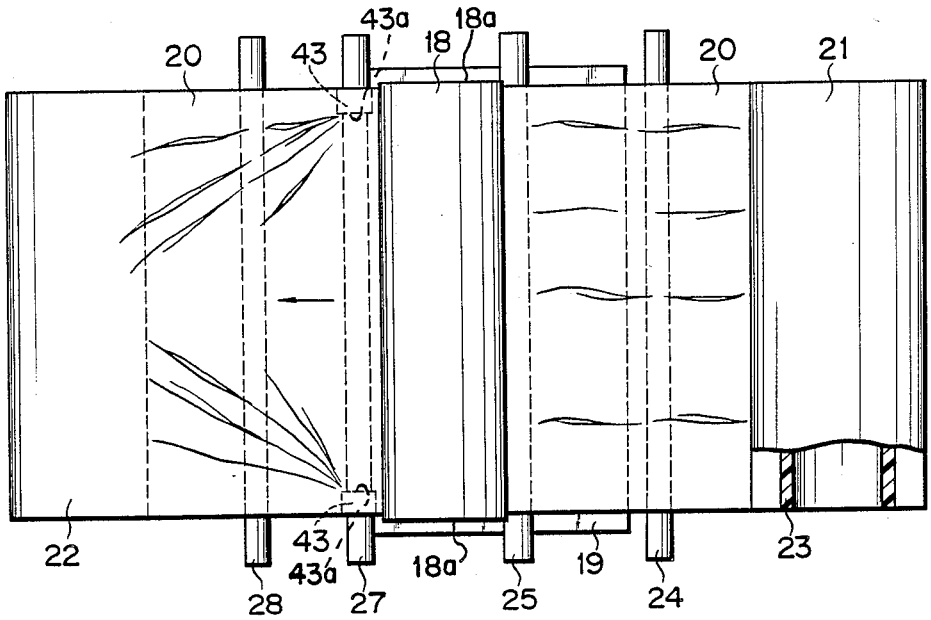
FIG. 5 is a plan view showing how a thermal transfer ribbon undulates in the apparatus according to the first embodiment.
Figure 6:
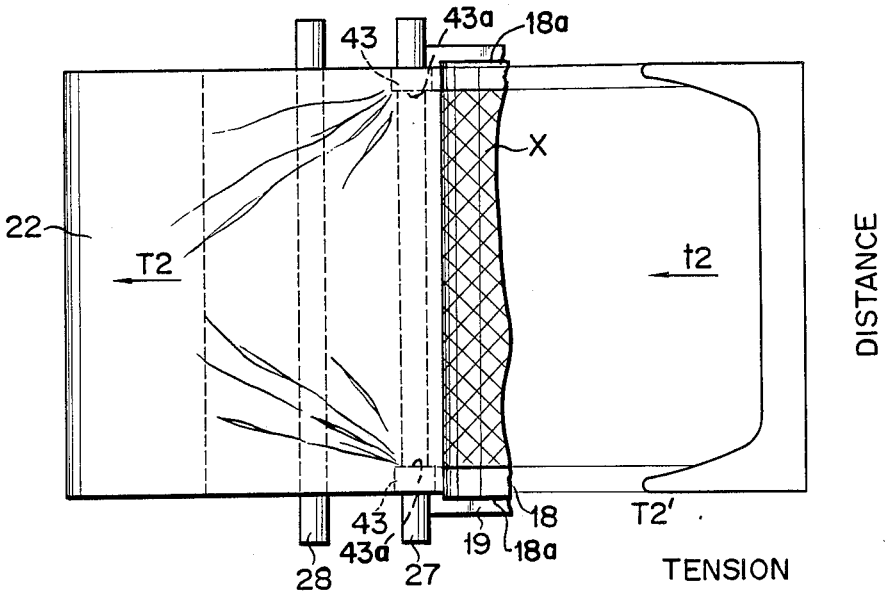
FIG. 6 is a plan view showing the distribution of tension on the thermal transfer ribbon according to the first embodiment.

When the thermal transfer ribbon 20 travels on the support members 43, that portion of the ribbon 20 which is located on the side of the take-up unit 22 with respect to the separation roller 27 concentrates its tension on the support members 43, and undulates in proportion to the transverse tension, as shown in FIG. 5. Thus, as shown in FIG. 6, the transverse tension on that portion of the ribbon 20 between the separation roller 27 and the platen roller 18 is increased to a high level (T2') by the support members 43 at both ends which are fitted to the separation roller 27. The transverse tension exhibits a substantially fixed small value (t2) in the intermediate portion of the printing region X (cross-patched part). Although the distribution of the winding tension T1 is not completely uniform across the width of the ribbon 20, it is symmetrical with respect to the longitudinal center line of the ribbon 2, and is substantially uniform in the central portion of the printing region X. Thus, the unevenness of tension which causes wrinkles is eliminated.

The sum total of the tension T2' at each end and the sum t2 of uniform intermediate tensions is equal to the winding tension T2. This may be expressed as follows: $T2 = 2T2' + t2$.

In the distribution of the transverse tension on that portion of the ribbon 20 on the side of the take-up unit 22 and in the vicinity of the platen roller 18, the intermediate tension distribution corresponding to the printing region X is made uniform by strongly pulling both sides of the ribbon 20. By doing this, the tension distribution can be made symmetrical with respect to the longitudinal center line of the ribbon 20. Thus, it is possible to prevent the formation of wrinkles on the ribbon 20 which are caused by the unevenness in strength and in direction of the tensions on the side of the take-up unit 22. As a consequence, printing errors can definitely be eliminated.

It is to be understood that the present invention is not limited to the above embodiment, and that various changes and modifications may be effected therein by one skilled in the art without departing from the scope or spirit of the invention.

Alternative embodiments of the present invention will now be described. In the description to follow, like reference numerals are used to designate the like portions described in connection with the first embodiment.

Figure 7:
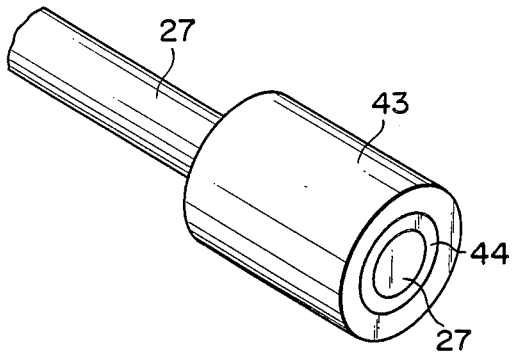
FIG. 7 is a perspective view schematically showing a modification of the first embodiment.

For example, in the first embodiment, the support members 43 are integrally fixed to each end of the separation roller 27. Without being limited to such an arrangement, however, each support member 43 may be rotatably attached to each corresponding end of the separation roller 27 by means of a bearing 44, as shown in a modification of the first embodiment in FIG. 7. In this case, the support members 43 at the two ends of the separation roller 27 are each in the form of, e.g., a cylinder which rotates as the ribbon 20 travels thereon.

Figure 8:
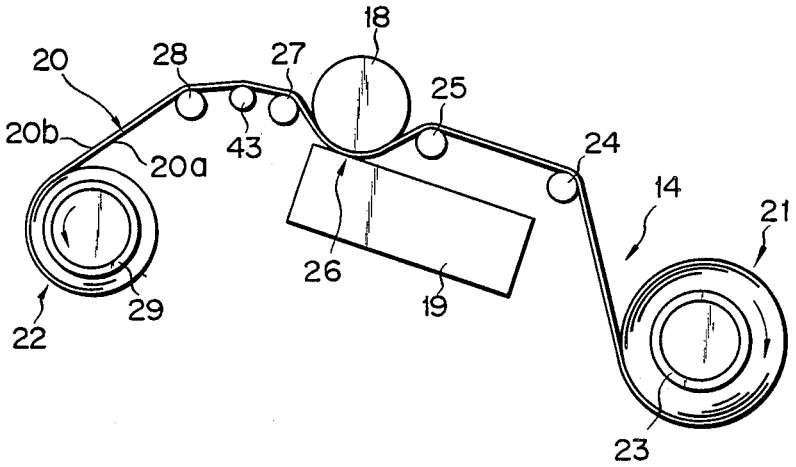
FIGS. 8 and 9 are a side view and a plan view, respectively, schematically showing a web feeding apparatus according to a second embodiment of the invention.
Figure 9:
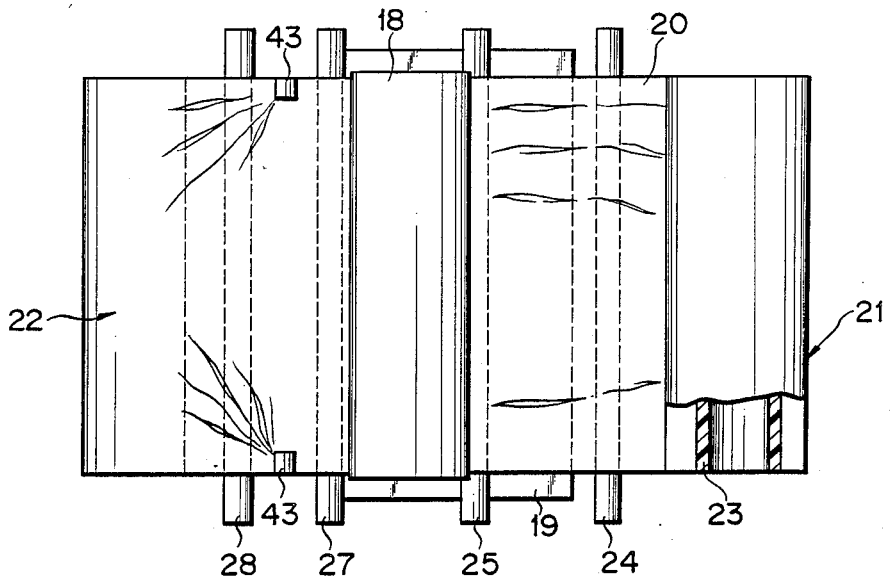
Figure 10:
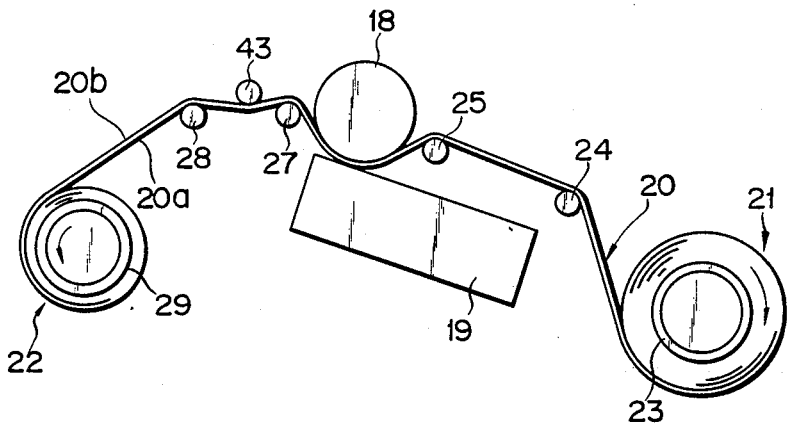
FIG. 10 is a side view schematically showing a modification of the web feeding apparatus according to the second embodiment.

In the above-mentioned first embodiment, moreover, the support members 43 are provided individually on both ends of the separation roller 27. Alternatively, however, the same effect may be obtained by providing the support members 43 independently of the separation roller 27, as shown in a second embodiment in FIGS. 8 and 9. In this case, the support members 43 may be arranged on the side of the base material **20*a* of the ribbon 20, as shown in FIG. 8, or on the side of the ink layer 20*b* of the ribbon 20, as shown in a modification of the second embodiment in FIG. 10. Also in the case where the support members 43 are located on the side of the ink layer 20*b*, the support members 43 are preferably rotated as the ribbon 2** travels thereon.

Although the above embodiments are applied to the feeding apparatus for the ribbon 20, it is to be understood that the invention is not limited to those embodiments, and may also be applied to a feeding apparatus for any web other than one in which the ribbon in the middle portion of the web needs to be clamped between a recording head and a platen roller which face each other when the web is fed.

According to the present invention, as described above, there is provided a web feeding apparatus which comprises a tension increasing means disposed on the lower side of a platen roller with respect to the web feeding direction and which is adapted to increase the tension on the edges of the web along the web feeding direction, thereby preventing the formation of wrinkles on that portion of the web which faces the platen roller. Thus, according to the web feeding apparatus of the invention in which the web, such as a thermal transfer ribbon, is fed in a manner such that the middle portion of the web is passed around the platen roller facing a recording head, the transverse tension on that portion of the web which faces the platen roller can be made uniform to prevent the formation of wrinkles using only a simple apparatus.

What is claimed is:

1. A thermal transfer recording apparatus for printing an image upon a sheet using a thermal transfer ribbon having elongated side edges and transverse rigidity, comprising a thermal head;

a platen roller, the sheet and thermal transfer ribbon being clamped between the platen roller and the thermal head in a recording area, an area of said thermal transfer ribbon with said recording area defining a printing range of said ribbon;

ribbon feeding means for feeding the thermal transfer ribbon in a first direction from an upstream ribbon supplying side, to a downstream ribbon winding side, along a path including the recording area;

a separation roller having a curved surface; and a pair of fixed tension increasing rollers, each having a curved surface, disposed downstream of the platen roller, coaxially disposed with respect to said separation roller, and separated from each other in a direction normal to said first direction, to contact with the side edges of the ribbon outside the printing range, to increase tension on the ribbon at the side edges thereof, along said first direction.

2. An apparatus as in claim 1 wherein said diameter of said support means is substantially 10% larger than said diameter of said separation roller means.

3. An apparatus as in claim 2 wherein said diameter of said separation roller means is 6 mm and said diameter of each support means is 6.6 mm.

* * * * *